US008291529B2

(12) United States Patent
Biersteker

(10) Patent No.: US 8,291,529 B2
(45) Date of Patent: Oct. 23, 2012

(54) SIDE PUSH HANDLES FOR A PATIENT LIFT

(75) Inventor: Melvin C. Biersteker, Los Angeles, CA (US)

(73) Assignee: Joerns Healthcare, LLC, Stevens Point, WI (US)

( * ) Notice: Subject to any disclaimer, the term of this patent is extended or adjusted under 35 U.S.C. 154(b) by 0 days.

(21) Appl. No.: 13/113,192

(22) Filed: May 23, 2011

(65) Prior Publication Data

US 2011/0302711 A1 Dec. 15, 2011

Related U.S. Application Data

(60) Provisional application No. 61/353,036, filed on Jun. 9, 2010.

(51) Int. Cl.
*A61G 7/10* (2006.01)

(52) U.S. Cl. ..... 5/83.1; 5/87.1; 5/86.1

(58) Field of Classification Search ..... 5/83.1, 5/85.1, 86.1, 87.1; 212/901; 254/8 B
See application file for complete search history.

(56) References Cited

U.S. PATENT DOCUMENTS

| | | | | |
|---|---|---|---|---|
| 5,892,180 | A * | 4/1999 | Carey | 177/144 |
| 6,175,973 | B1 | 1/2001 | Hakamiun | |
| 6,289,534 | B1 | 9/2001 | Hakamiun | |
| 6,857,144 | B1 | 2/2005 | Huang | |
| 7,428,759 | B2 * | 9/2008 | Bain et al. | 5/86.1 |
| 7,647,655 | B2 | 1/2010 | Liljedahl | |
| 7,921,485 | B2 * | 4/2011 | Biersteker et al. | 5/83.1 |
| 2006/0045708 | A1 | 3/2006 | Bain et al. | |
| 2011/0289681 | A1 * | 12/2011 | Biersteker | 5/86.1 |

FOREIGN PATENT DOCUMENTS

| | | | |
|---|---|---|---|
| EP | 241096 | A2 * | 10/1987 |
| JP | 2001314458 | A | 11/2001 |
| WO | 0044328 | A1 | 8/2000 |

OTHER PUBLICATIONS

International Search Report and Written Opinion, Application No. PCT/US2011/038513, Dated Mar. 2, 2012.

* cited by examiner

*Primary Examiner* — Michael Trettel
(74) *Attorney, Agent, or Firm* — MacMillan, Sobanski & Todd, LLC

(57) ABSTRACT

A patient lift includes a base with one or more casters supporting the base for movement relative to a support surface. A mast is supported by the base and extends generally upwards. An elongated boom is mounted for pivotal movement relative to the mast and extends in a forward direction. The boom is adapted to support a patient. An actuator is operatively connected to the boom, and the actuator is adapted to be driven to move the boom relative to the mast in order to move the supported patient relative to the support surface. The patient lift also includes a handle assembly mounted to the mast. The handle assembly includes a first side handle that extends to a position on the forward side of the mast.

22 Claims, 5 Drawing Sheets

SIDE PUSH HANDLES FOR A PATIENT LIFT

CROSS-REFERENCE TO RELATED APPLICATIONS

This application claims the benefit of U.S. Provisional Application No. 61/353,036, filed Jun. 9, 2010, the disclosure of which is incorporated herein by reference.

BACKGROUND OF THE INVENTION

This invention relates in general to patient lifting and transferring. In particular, the invention relates to a device for lifting a patient from a bed or some other apparatus (wheelchair, bath, etc.) and permitting the patient to be readily moved.

It is often desirable to assist a patient or disabled person in moving from a bed, chair, or other position. To assist these patients, it is common to have a patient lifting hoist, which can raise a person in a sitting position. This is particularly useful when the patient lacks the strength or coordination to lift himself. An attendant or caregiver may be required to assist the patient in using the device.

A lifting hoist typically includes a mast that supports a movable arm. The movable arm includes attachment points for a sling that is used for supporting a patient. The sling may be raised and lowered by the movable arm. In a lifting hoist, the patient is typically completely supported from an overhead position and has no active role in supporting himself. A lifting hoist is commonly used to temporarily raise a patient or transport the patient without discomfort.

In order for a lifting hoist to be used to transport a supported patient, the lifting hoist typically includes wheels or casters. These casters allow the attendant to move the hoist into position, and to roll the lifting hoist on the support surface while the patient is supported in the sling. The lifting hoist also typically includes a handle mounted on the mast. The handle allows the attendant to apply pushing and pulling forces in order to move and maneuver the lifting hoist.

SUMMARY OF THE INVENTION

This invention relates to a patient lift that includes a base with one or more casters supporting the base for movement relative to a support surface. A mast is supported by the base and extends generally upwards. An elongated boom is mounted for pivotal movement relative to the mast and extends in a forward direction. The boom is adapted to support a patient. An actuator is operatively connected to the boom, and the actuator is adapted to be driven to move the boom relative to the mast in order to move the supported patient relative to the support surface. The patient lift also includes a handle assembly mounted to the mast. The handle assembly includes a first side handle that extends to a position on the forward side of the mast.

This invention also relates to a patient lift that includes a base with casters supporting the base for movement relative to a support surface. The patient lift includes a mast extending from the base and an elongated boom mounted for pivotal movement relative to the mast and extending in a forward direction. The boom is adapted to support a patient. An actuator is operatively connected to the boom. The actuator is adapted to be driven to move the boom relative to the mast in order to move the supported patient relative to the support surface. The patient lift also includes a handle assembly mounted on the mast. The handle assembly is adapted so that the lift can be moved in a direction transverse to the forward direction by applying a side force to the handle assembly in the direction transverse to the forward direction.

This invention also relates to a patient lift that includes a base with casters supporting the base for movement relative to a support surface. A mast is supported by the base and extends generally upwards. An elongated boom is mounted for pivotal movement relative to the mast and extends in a forward direction. The boom is adapted to support a patient. An actuator is operatively connected to the boom, and is adapted to be driven to move the boom relative to the mast in order to move the supported patient relative to the support surface. The patient lift also includes a handle assembly mounted on the mast. The handle assembly includes a rear handle that is attached to the mast at two points. The handle assembly also includes a first side handle that extends in the forward direction from the rear handle. The first side handle is attached to the rear handle at two points.

Various aspects of this invention will become apparent to those skilled in the art from the following detailed description of the disclosed embodiments, when read in light of the accompanying drawings.

DETAILED DESCRIPTION OF THE PREFERRED EMBODIMENTS

Figure 1:
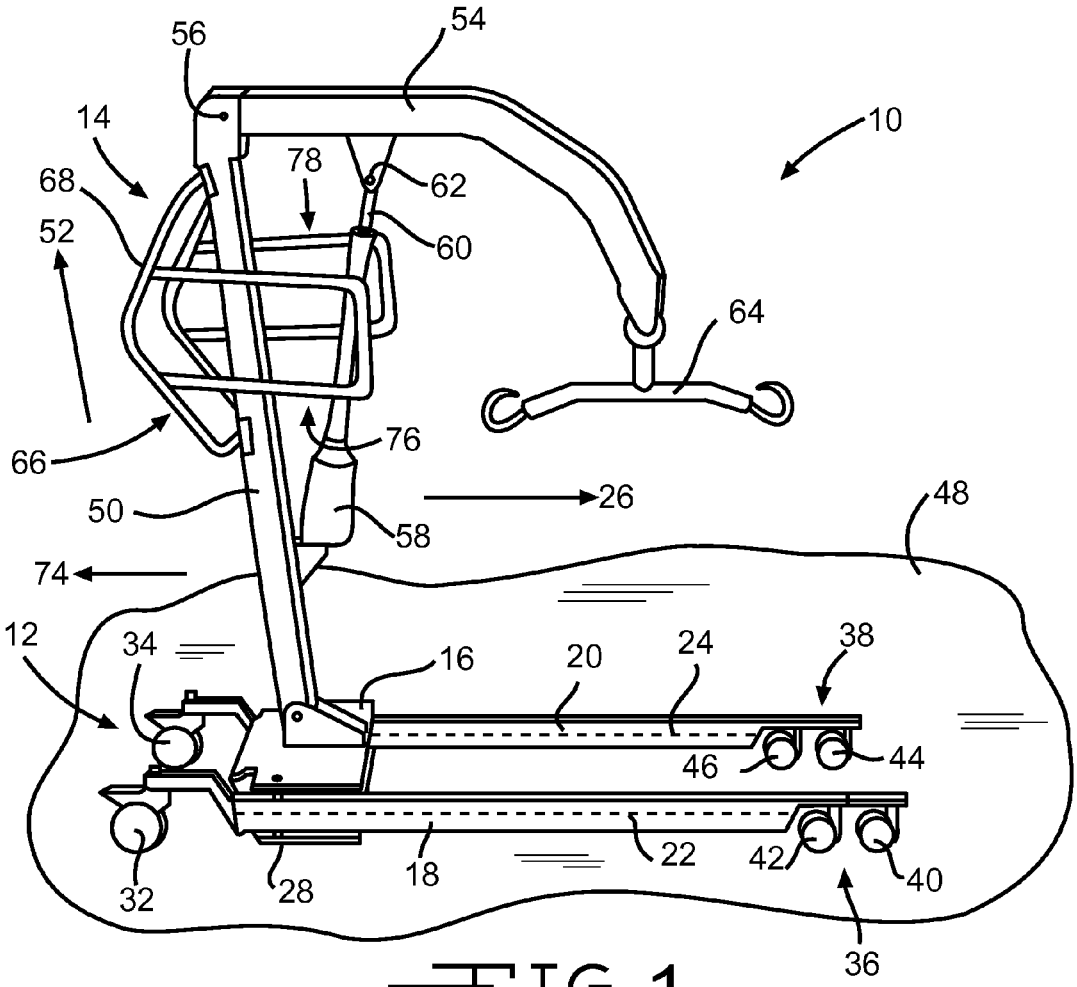
FIG. 1 is a perspective view of a patient lift that includes a handle assembly having side push handles.

Referring now to the drawings, there is illustrated in FIG. 1 one embodiment of a patient lift 10. The patient lift 10 is a patient lifting hoist. Alternatively, the patient lift 10 may be some other type of lift, such as a stand-assist device. The patient lift 10 includes a base assembly indicated generally at 12, and a mast assembly indicated generally at 14. The components of the patient lift 10 may be made of metal, plastic, or other desired materials.

The base assembly 12 includes a base 16. The base assembly 12 also includes a first elongated leg 18 and a second elongated leg 20. The first elongated leg 18 and the second elongated leg 20 extend from the base 16. The first elongated leg includes a first longitudinal axis 22. The second elongated leg includes a second longitudinal axis 24. The first elongated leg 18 and the second elongated leg 20 extend from the base 16 generally in a forward direction, which is indicated by the arrow 26.

The first elongated leg 18 and the second elongated leg 20 are attached to the base 16 at a first leg hinge 28 and a second leg hinge (not visible in FIG. 1), respectively. The first leg hinge 28 and the second leg hinge allow the first elongated leg 18 and the second elongated leg 20 to pivot relative to the base 16. This allows the first elongated leg 18 and the second elongated leg 20 to be moved through ranges of motion into various positions to facilitate stability, transportation and storage of the patient lift 10. It should be appreciated that the first elongated leg 18 and the second elongated leg 20 may be fixed relative to the base 16, if desired.

The base assembly 12 includes a pair of rear casters, 32 and 34. The rear casters 32 and 34 are mounted for pivotal movement relative to the base 16. The rear casters 32 and 34 are locking casters; however, other desired types of casters may be used on the patient lift 10. The rear casters 32 and 34 may be mounted on the base 16, if desired. It should also be appreciated that the base assembly 12 may include fewer than or more than the two rear casters 32. For example, the patient lift 10 may have a single rear wheel mounted relative to the base 16.

The base assembly 12 also includes a first caster assembly indicated at 36 and a second caster assembly indicated at 38. The first caster assembly 36 is mounted relative to the first elongated leg 18 and the second caster assembly 38 is mounted relative to the second elongated leg 20. The first caster assembly 36 includes a first forward assembly caster 40 and a first rearward assembly caster 42. However, the first caster assembly 36 may include more or fewer casters. The first forward assembly caster 40 and the first rearward assembly caster 42 are mounted for pivotal movement relative to the first elongated leg 18. The second caster assembly 38 includes a second forward assembly caster 44 and a second rearward assembly caster 46. However, the second caster assembly 38 may include more or fewer casters. The second forward assembly caster 44 and the second rearward assembly caster 46 are mounted for pivotal movement relative to the second elongated leg 20.

The patient lift 10 is supported on a support surface 48 by the rear casters 32 and 34, and the assembly casters 40, 42, 44, and 46. The patient lift is able to be moved relative to the support surface 48 by rolling on the casters. The rear casters 32 and 34, and the assembly casters 40, 42, 44, and 46 are adapted to pivot relative to the base assembly 12 in order to allow the patient lift 10 may be moved in any direction along the support surface 48.

The mast assembly 14 of the patient lift 10 includes a mast 50. The mast 50 is mounted on the base 16. The mast 50 extends in a first direction 52 from the base 16. It should be appreciated that the first direction 52 is generally upwards. The mast assembly 14 includes a boom 54 pivotally mounted on the mast 16 at a boom hinge 56. The boom 54 extends from the mast 50 in the forward direction 26. An electric motor 58 is mounted on the mast 50. The electric motor 58 is operable to drive an actuator 60. The actuator 60 is attached to the boom 54 at an actuator hinge 62. The electric motor 58 may be operated to drive the actuator 60 in order to cause the boom 54 to rotate relative to the mast 50.

A support hanger 64 is pivotally supported at a distal end of the boom 54. The support hanger 64 is a set of spreader arms, and is adapted to support a sling (not shown). The sling may be attached to a patient or other load (not shown). When the sling is attached to a patient and is supported by the support hanger 64, the electric motor 58 may be operated to cause the boom 54 to rotate relative to the mast 50. This allows the patient to be raised and lowered relative to the support surface 48 by the patient lift 10. It should be appreciated that the support hanger 64 may be any other desired structure, rather than spreader arms, depending on the type of patient lift.

The patient lift 10 also includes a handle assembly, indicated generally at 66. The handle assembly 66 is mounted to the mast 50. Alternatively, the handle assembly 66 may be mounted to some other part of the patient lift 10, such as the base 16, if desired. The handle assembly 66 is adapted to allow a caregiver or attendant to apply a force in order to push, pull, move, maneuver, or manipulate the patient lift 10 relative to the support surface 48.

Figure 2:
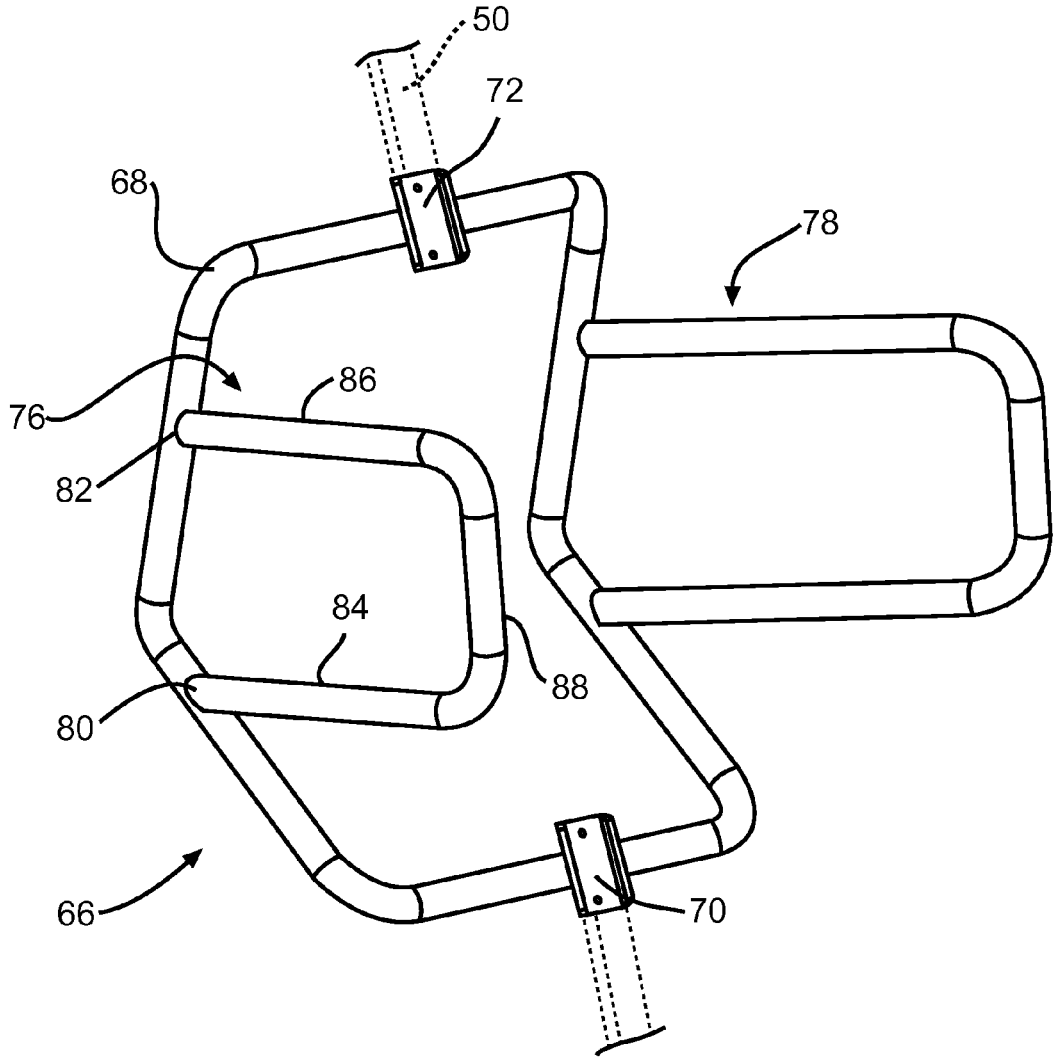
FIG. 2 is a perspective view of the handle assembly of the lift shown in FIG. 1.

As shown in FIG. 1, the handle assembly 66 includes a rear handle 68, a first side handle 76, and a second handle 78. The handle assembly 66 is made of aluminum tubes. However, the handle assembly may be made of other desired materials, such as steel or plastic. As shown in FIG. 2, the rear handle 68 comprises a series of tubular components that are generally arranged in a loop-shape. The rear handle 68 may have a shape different from that shown, if desired. The rear handle 68 is attached to the mast 50 at a first attachment point 70 and a second attachment point 72. As shown, the first attachment point 70 is a lower attachment point and the second attachment point 72 is an upper attachment point. Alternatively, the rear handle 68 may be attached to the mast 50 using other attachment arrangements. The rear handle 68 may be attached to the mast 50 by bolts, rivets, welds, adhesives, or other desired fasteners or any other fastening mechanism. The rear handle 68 is attached to the mast 50 on a rearward side of the mast 50. As can be seen in reference to FIG. 1, the rearward direction is indicated by the arrow 74. The rear handle 68 may be mounted on some other side the mast 50, if desired. The rear handle 68 is situated on the rearward side of the mast 50. It should be appreciated that the rear handle 68 may be configured so that a portion of the rear handle 68 or the entire rear handle 68 is on the forward side 26 of the mast 50.

The handle assembly 66 also includes a first side handle, indicated generally at 76 and a second side handle, indicated generally at 78. The first side handle 76 and the second side handle 78 are substantially similar, and only the first side handle 76 will be described in detail. It should be appreciated that the first side handle 76 and the second side handle 78 may have different designs from each other, if desired. The first side handle 76 comprises a series of tubular components that are arranged in a C-shape. The first side handle 76 may have a shape different from that shown, if desired.

As can be seen in further reference to FIG. 2, the first side handle 76 is attached to the rear handle 68 at a first side attachment point 80 and a second side attachment point 82. The first side handle 76 may be attached to the rear handle 68 by bolts, rivets, welds, adhesives, or other desired fasteners. Alternatively, the first side handle 76 may be an extension of one of the components of the rear handle 68. The first side attachment point 80 and the second side attachment point 82 are at the ends of the C-shaped first side handle 76. It should be appreciated that the first side handle 76 may be attached to the rear handle 66 at more or fewer points, if desired. Additionally, it should be appreciated that the attachment points between the first side handle 76 and the rear handle 68 may be at different locations than shown. Also, it should be appreciated that the first side handle 76 may be attached directly to the mast 50, or to some other desired component of the patient lift 10.

The first side handle 76 includes a lower bar 84 and an upper bar 86. The lower bar 84 is attached to the rear handle 68 at the first side attachment point 80 and extends generally in the forward direction 26. The lower bar 84 is substantially parallel to the support surface 48. Alternatively, the lower bar 84 may be oriented other than substantially parallel to the support surface 48. The upper bar 86 is attached to the rear handle 68 at the second side attachment point 82 and extends generally in the forward direction 26. The upper bar 86 is substantially parallel to the support surface 48. Alternatively, the upper bar 86 may be oriented other than substantially parallel to the support surface 48. The lower bar 84 and the upper bar 86 are joined at their distal ends by a connecting bar 88. The lower bar 84 and the upper bar 86 may be joined at other desired locations.

Figure 3:
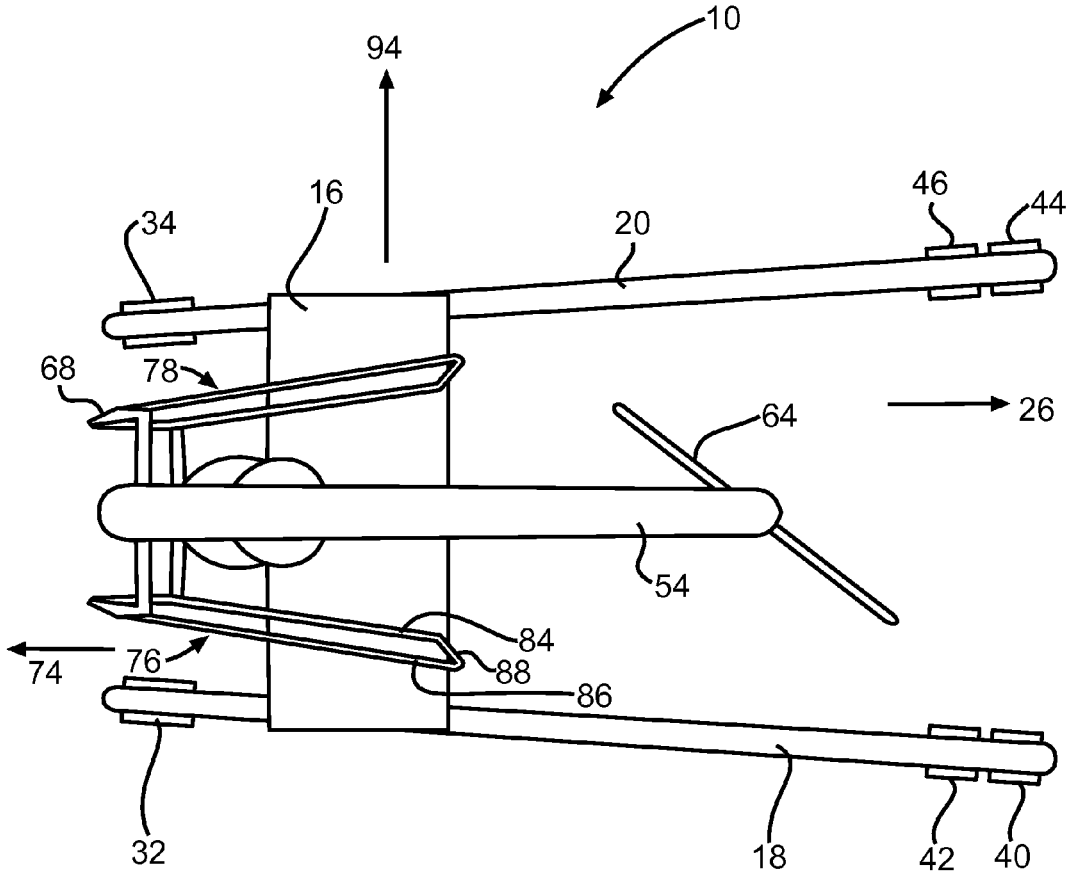
FIG. 3 is a plan view, taken from above, of the patient lift of FIG. 1.

Referring now to FIG. 3, an overhead view of the patient lift 10 is shown. The first side handle 76 extends from the rear handle 76 to the forward side 26 of the mast 50 (the mast 50 is not visible in FIG. 3 because it is hidden by the boom 54). This allows an attendant or caregiver to grip the first side handle 76 or the second side handle 78 while tending to or interacting with a patient supported by the support hanger 64. This is advantageous in that it allows the caregiver to move the patient lift 10 while interacting with the supported patient. As can also be seen in FIG. 3, the first side handle 76 and the second side handle 78 are arranged so that they diverge from each other laterally. That is, the distance between the first side handle 76 and the second side handle 78 increases in the forward direction 26. This provides additional space between the first side handle 76 and the second side handle 78 closer to the patient. It should be appreciated that the first side handle 76 and the second side handle 78 may have a different configuration than that shown, and may be parallel to each other, if desired. Further, one or both of the first side handle 76 and the second side handle 78 may be moveable relative to the rear handle 68, in order to allow for adjustment of the first side handle 76 and the second side handle 78 to accommodate patients of different sizes.

It should be appreciated that the handle assembly 66 may be made as a single unit, or it may be made of sections so that the first side handle 76 and the second side handle 78 may be adjusted or removed from the handle assembly 66, if desired. Additionally, the handle assembly 66 may be installed as the original handle on the patient lift 10, or it may be made as a replacement handle for another patient lift.

Figure 4:
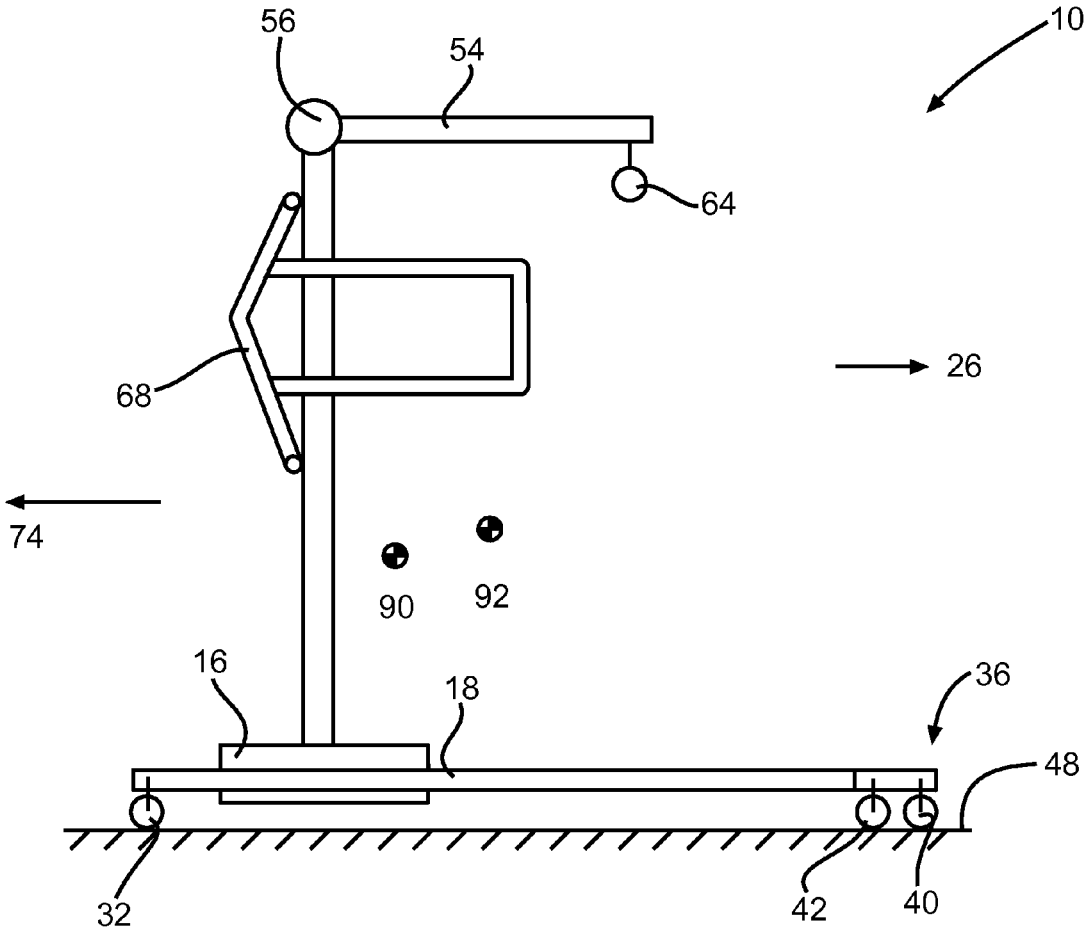
FIG. 4 is a schematic view, taken from one side, of the patient lift of FIG. 1.

Referring now to FIG. 4, a side, schematic view of the patient lift 10 is shown. The center approximate of gravity of the patient lift 10 is shown by the point 90. Additionally, the loaded center of gravity of the patient lift 10 when it is supporting a patient is shown by the point 92. It should be appreciated that the location of the loaded center of gravity 92 will vary depending on the weight of the patient supported by the lift. However, the location of the loaded center of gravity 92 can be estimated based on the maximum design load of the patient lift 10.

As shown, the first side handle 76 extends in the forward direction 26 beyond the loaded center of gravity 92. As a result, the caregiver is able to apply a sidewise force to the first side handle 76 in a direction that is transverse to the first direction 26 and that passes through the loaded center of gravity 92. Thus, the first side handle 76 allows the caregiver to more easily push the patient lift 10 in a sidewise direction, or a direction transverse to the forward direction 26 (indicated by arrow 94 in FIG. 3). It should be appreciated that the first side handle 76 and the second side handle 78 allow the attendant to apply a pushing or pulling force through the center of gravity of the loaded lift in a variety of directions. Thus, the attendant is able to move the patient lift 10 in a variety of directions with the application of a direct force. The attendant is also able to move the patient lift 10 in a variety of directions while applying the direct force on a handle that is designed for having such a force applied to it. This reduces the likelihood of the attendant pushing on a part of the lift not designed to be pushed.

Figure 5:
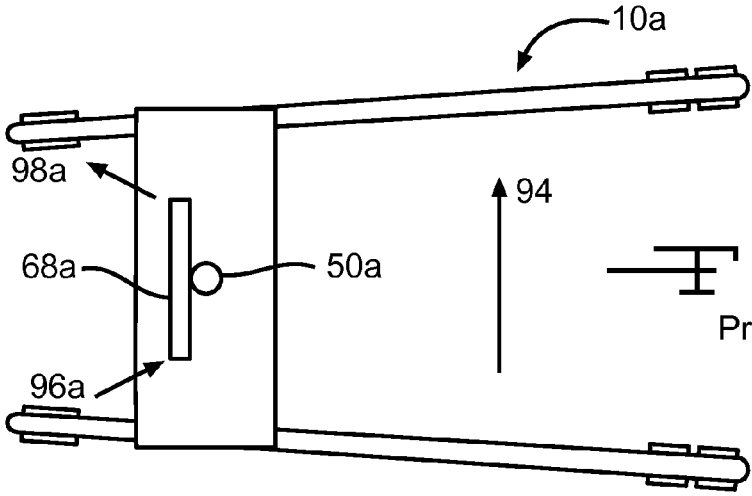
FIG. 5 Prior Art
FIG. 5 is a schematic view, taken from above, of a prior art patient lift.

When a patient lift that does not include the first side handle 76 and the second side handle 78, the attendant has greater difficulty in moving the patient lift. Referring to FIG. 5, there is shown an overhead, schematic view of a prior art patient lift 10*a* that includes a rear handle 68*a*, but does not include any side handles. When the attendant wishes to move the patient lift 10*a* in a sidewise direction 94, the attendant grips the rear handle 68*a* on opposite sides of the mast 50*a*. The attendant then applies a pushing force 96*a* to the rear handle 68 on one side of the mast 50, and applies a pulling force 98*a* to the rear handle 68 on the opposite side of the mast 50. These two forces combine to provide a total force sufficient to move the patient lift in the sidewise direction 94. Alternatively, in order to move the lift 10*a* in a sidewise direction, the attendant may apply a force to a portion of the lift 10*a* that is not designed for the application of a force. For example, the attendant may apply a force to the mast 50*a* or the boom (not shown). The attendant may apply a force to these elements because they are conveniently located. However, this may result in damage to the lift 10*a*, such as damage to the actuator (not shown) caused by pushing on the boom.

In addition to making it easier for a single attendant to maneuver the patient lift 10, the first side handle 76 and the second side handle 78 also allow for a greater number of attendants to manipulate the patient lift 10 simultaneously. This can be beneficial when attempting to transport a bariatric patient, in a situation where the single attendant may lack the strength to move the loaded patient lift. In that case, multiple attendants may grip the rear handle 68, the first side handle 76, and the second side handle 78 in order to apply force to move the patient lift 10. This can also be beneficial in a confined space, such as a narrow hallway, where multiple attendants are situated on different sides of the patient lift 10.

Figure 6:
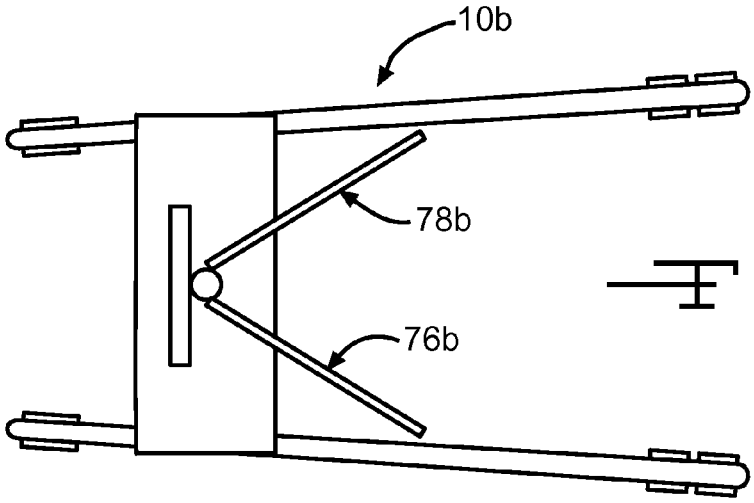
FIG. 6 is a schematic view, taken from above, of a patient lift including an alternative embodiment of a side handle.
Figure 7:
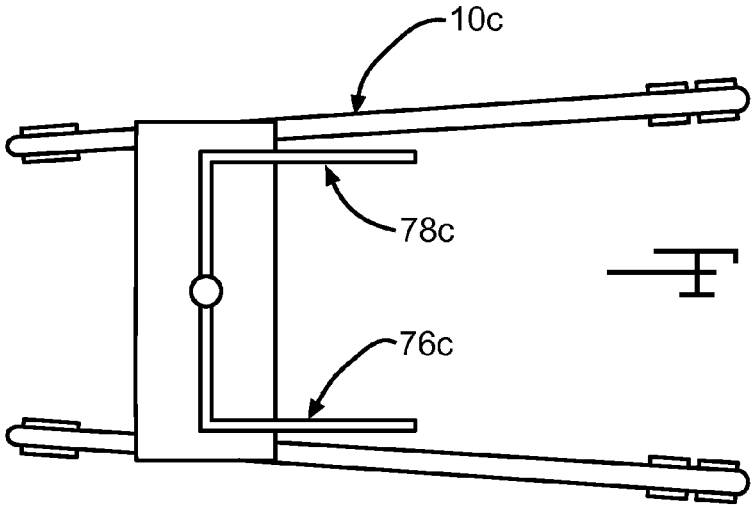
FIG. 7 is a schematic view, taken from above, of a patient lift including an alternative embodiment of a side handle.

Referring to FIGS. 6 and 7, alternative configurations of the side handles are shown. A first handle 76*b*, shown in FIG. 6, may consist of a bar that extends directly from the mast at an angle from the forward direction. Referring to FIG. 7, a first side handle 76*c* may be a bar that extends from the mast and includes a portion that extends substantially in the forward direction. It should be appreciated that the first handles 76*b* and 76*c* may be a single bar, or may be multiple bars. It should also be appreciated that other desired configurations of the first handle may be used.

The principle and mode of operation of this invention have been explained and illustrated in its preferred embodiments. However, it must be understood that this invention may be practiced otherwise than as specifically explained and illustrated without departing from its spirit or scope.

What is claimed is:

1. A patient lift comprising:

a base;

one or more casters supporting the base for movement relative to a support surface;

a mast supported by the base and extending generally upwards;

an elongated boom mounted for pivotal movement relative to the mast and extending in a forward direction, the boom adapted to support a patient;

an actuator operatively connected to the boom, the actuator adapted to be driven to move the boom relative to the mast in order to move the supported patient relative to the support surface; and a handle assembly mounted to the mast, the handle assembly including a first side handle that extends to a position forward of the mast and a second side handle that extends to a position forward of the mast, wherein the distance between the first side handle and the second side handle increases in the forward direction.

2. The patient lift of claim 1, the first side handle including a portion that extends to a position forward of the mast and is substantially parallel to the support surface.

3. The patient lift of claim 1, the first side handle including a lower bar that is substantially parallel to the support surface and an upper bar that is substantially parallel to the support surface.

4. The patient lift of claim 1, the handle assembly adapted so that a side force may be applied to the first side handle in a direction substantially transverse to the forward direction and through the center of gravity of the lift when the lift is supporting the patient.

5. The patient lift of claim 4, wherein the handle assembly is adapted so that the lift can be moved in a direction transverse to the forward direction by applying the side force to the first side handle.

6. A patient lift comprising:

a base;

casters supporting the base for movement relative to a support surface;

a mast extending from the base;

an elongated boom mounted for pivotal movement relative to the mast and extending in a forward direction, the boom adapted to support a patient;

an actuator operatively connected to the boom, the actuator adapted to be driven to move the boom relative to the mast in order to move the supported patient relative to the support surface; and a handle assembly mounted on the mast and extending in the forward direction so that a side force may be applied to the handle assembly in a direction substantially transverse to the forward direction and through the loaded center of gravity of the lift when the lift is supporting a bariatric patient.

7. The patient lift of claim 6, the handle assembly adapted so that the lift can be moved in a direction transverse to the forward direction by applying the side force to the handle assembly in the direction transverse to the forward direction.

8. The patient lift of claim 7 wherein the boom is adapted to support a bariatric patient.

9. The patient lift of claim 7, wherein the handle assembly includes a first side handle that extends in the forward direction a sufficient distance from the mast to allow an attendant to grip the first side handle while tending to the patient.

10. The patient lift of claim 9, further comprising a second side handle that extends in the forward direction a sufficient distance from the mast to allow an attendant to grip the second side handle while tending to the patient.

11. The patient lift of claim 7, wherein the handle assembly includes a first side handle that is mounted to the mast and extends in the forward direction to a position forward of the mast.

12. The patient lift of claim 11, wherein the first side handle comprises a bar extending at an angle from the forward direction.

13. The patient lift of claim 11, wherein the first side handle includes a portion extending substantially in the forward direction.

14. The patient lift of claim 11, wherein the first side handle includes an upper bar, a lower bar, and a connecting bar that is attached to the upper bar and the lower bar.

15. The patient lift of claim 11, wherein the handle assembly includes a second side handle that is mounted to the mast and extends in the forward direction to a position forward of the mast, and wherein the distance between the first side handle and the second side handle increases in the forward direction.

16. A patient lift comprising:

a base;

casters supporting the base for movement relative to a support surface;

a mast supported by the base and extending generally upwards;

an elongated boom mounted for pivotal movement relative to the mast and extending in a forward direction, the boom adapted to support a patient;

an actuator operatively connected to the boom, the actuator adapted to be driven to move the boom relative to the mast in order to move the supported patient relative to the support surface; and a handle assembly mounted on the mast, the handle assembly including a rear handle that is attached to the mast at two points, the handle assembly further including a first side handle that extends in the forward direction from the rear handle, the first side handle attached to the rear handle at two points.

17. The patient lift of claim 16, wherein the first side handle extends to a position forward of the mast.

18. The patient lift of claim 17, the first side handle including a lower bar and an upper bar.

19. The patient lift of claim 18, further comprising an extended handle that is connected to the lower bar and the upper bar.

20. The patient lift of claim 19, the handle assembly further comprising a second side handle that extends in the forward direction from the rear handle to a position forward of the mast, the second side handle attached to the rear handle at two points, the second side handle including a lower bar, an upper bar and an extended handle that is connected to the lower bar and the upper bar.

21. A patient lift comprising:

a base;

one or more casters supporting the base for movement relative to a support surface;

a mast supported by the base and extending generally upwards;

an elongated boom mounted for pivotal movement relative to the mast and extending in a forward direction, the boom adapted to support a patient;

an actuator operatively connected to the boom, the actuator adapted to be driven to move the boom relative to the mast in order to move the supported patient relative to the support surface; and a handle assembly mounted to the mast, the handle assembly including a first side handle that extends to a position forward of the mast, the first side handle including a lower bar that is substantially parallel to the support surface and an upper bar that is substantially parallel to the support surface.

22. A patient lift comprising:

a base;

casters supporting the base for movement relative to a support surface;

a mast extending from the base;

an elongated boom mounted for pivotal movement relative to the mast and extending in a forward direction, the boom adapted to support a patient;

an actuator operatively connected to the boom, the actuator adapted to be driven to move the boom relative to the mast in order to move the supported patient relative to the support surface; and a handle assembly mounted on the mast, the handle assembly adapted so that a side force may be applied to the handle assembly in a direction substantially transverse to the forward direction and through the loaded center of gravity of the lift when the lift is supporting the patient;

the handle assembly adapted so that the lift can be moved in a direction transverse to the forward direction by applying the side force to the handle assembly in the direction transverse to the forward direction;

wherein the handle assembly includes a first side handle that is mounted to the mast and extends in the forward direction to a position forward of the mast, the first side handle includes an upper bar, a lower bar, and a connecting bar that is attached to the upper bar and the lower bar.

* * * * *